US012722920B2

(12) United States Patent
Capaccioni et al.

(10) Patent No.: US 12,722,920 B2
(45) Date of Patent: Sep. 1, 2026

(54) HIDE FEEDING APPARATUS IN LINES FOR THE TREATMENT OR WORKING OF HIDES

(71) Applicants: BARNINI S.R.L., Castelfranco di Sotto Pi (IT); ROBOT SYSTEM AUTOMATION S.R.L., Casciana Terme Lari Pi (IT)

(72) Inventors: Marco Capaccioni, Casciana Terme Lari Pi (IT); Marco Minutillo, Casciana Terme Lari Pi (IT); Claudio Pinori, Casciana Terme Lari Pi (IT); Lorenzo Simoni, Castelfranco di Sotto Pi (IT); Matteo Simoni, Castelfranco di Sotto Pi (IT)

(73) Assignees: BARNINI S.R.L., Castelfranco di Sotto Pi (IT); ROBOT SYSTEM AUTOMATION S.R.L., Casciana Terme Lari Pi (IT)

( * ) Notice: Subject to any disclaimer, the term of this patent is extended or adjusted under 35 U.S.C. 154(b) by 210 days.

(21) Appl. No.: 18/685,954

(22) PCT Filed: Aug. 23, 2022

(86) PCT No.: PCT/IB2022/057884
§ 371 (c)(1),
(2) Date: Feb. 23, 2024

(87) PCT Pub. No.: WO2023/026184
PCT Pub. Date: Mar. 2, 2023

(65) Prior Publication Data

US 2024/0351810 A1 Oct. 24, 2024

(30) Foreign Application Priority Data

Aug. 24, 2021 (IT) ..... 102021000022235

(51) Int. Cl.
*B65H 3/08* (2006.01)
*B65H 5/02* (2006.01)

(52) U.S. Cl.
CPC ..... *B65H 3/0833* (2013.01); *B65H 5/021* (2013.01); *B65H 2301/44724* (2013.01); *B65H 2701/178* (2013.01)

(58) Field of Classification Search
CPC ..... B65H 3/0833; B65H 5/021; B65H 2301/44724; B65H 2301/4473; B65H 2701/178; C14B 17/06
(Continued)

(56) References Cited

U.S. PATENT DOCUMENTS 1,695,963 A * 12/1928 Koeniger ..... C14B 1/40 69/32
1,704,196 A * 3/1929 Jones ..... C14B 1/12 15/93.1
(Continued)

FOREIGN PATENT DOCUMENTS

FR 2256893 A1 8/1975
IT M20070273 A1 4/2009
(Continued)

OTHER PUBLICATIONS

International Search Report and Written Opinion for Corresponding International Application No. PCT/IB2022/057884, 11 pages, Dec. 8, 2022.

*Primary Examiner* — Jocelyn Bravo
(74) *Attorney, Agent, or Firm* — LUCAS & MERCANTI, LLP

(57) ABSTRACT

The present invention concerns the sector of leather treatment or working lines, in particular but not exclusively to tannery processings. In particular, the invention relates to a tendentially automatic or semi-automatic apparatus for loading incoming leathers on one of these lines, the apparatus
(Continued)

being provided with means for lifting and advancing individual leathers starting from a stacking station, and with systems for the spread out and sequential arrangement of the single leathers on a conveyor surface of the line, downstream of the apparatus.

19 Claims, 6 Drawing Sheets

(58) Field of Classification Search
USPC ..... 69/44
See application file for complete search history.

(56) References Cited

U.S. PATENT DOCUMENTS 1,763,359 A * 6/1930 Johnson ..... C14B 1/12 69/44
3,623,719 A 11/1971 Dokoupil et al.
5,415,389 A * 5/1995 Adami ..... B65H 33/12 83/155.1
5,535,576 A * 7/1996 Walintschek ..... B65B 25/141 53/260
9,242,825 B2 * 1/2016 Foerch ..... B65H 5/224
2003/0155701 A1 8/2003 Bakodledis
2013/0176422 A1 * 7/2013 Campbell ..... G06V 10/243 348/95
2013/0177215 A1 7/2013 Campbell et al.
2016/0152432 A1 * 6/2016 Corsico Piccolino ..... B65H 35/0066 226/196.1

FOREIGN PATENT DOCUMENTS

IT 202000003236 A1 8/2021
SU 1283203 A1 1/1987
WO 2016180903 A1 11/2016

* cited by examiner

HIDE FEEDING APPARATUS IN LINES FOR THE TREATMENT OR WORKING OF HIDES

CROSS-REFERENCE TO RELATED APPLICATIONS

This application is a 371 of PCT/IB2022/057884, filed Aug. 23, 2022, which claims the benefit of Italian Patent Application No. 102021000022235, filed Aug. 24, 2021.

FIELD OF THE INVENTION

The present invention concerns the fields of lines or plants for treating or working flexible laminar elements.

BACKGROUND OF THE INVENTION

The expression "flexible laminar elements" is intended here to mean natural hides, synthetic leathers, fabrics, non-woven fabrics, flexible plastics and related or similar materials, all elements in which thickness is much lower than the other two dimensions (length and width).

In particular, but not exclusively, the present invention is particularly suitable for use in the tanning industry for picking, transporting and unloading hides, or synthetic leather, from one workstation to another, along the leather treatment or working lines. In particular, the invention relates to a tendentially automatic or semi-automatic apparatus for loading incoming leathers on one of these lines.

In tannery processings, and more generally where large-sized hides are to be moved, the problem of correctly loading the pieces on the treatment and working lines, and in particular on the transport surfaces with which these lines are provided, is very deeply felt. The loading of the single pieces in sequence must in fact ensure a positioning thereof in an orderly manner and above all satisfies a condition of complete spreading of the leather on the surface, without overturned flaps, folds, wrinkles or irregularities in general.

This is a requirement that, if not met, can compromise the quality of the subsequent processings, or in any case slow them down. Moreover, the sizes, the weight, the irregular profile of the leathers as well as the nature of the material itself are obstacles. Recourse to the manual intervention of a dedicated workforce to carry out or in any case assist with the loading operations remains currently almost obligatory, with all that this entails in terms of operating times and costs (also to ensure compliance with safety regulations).

Indeed, loading apparatuses have been proposed with the task of providing automatic or semi-automatic handling of the leathers and loading them onto the line, overcoming or at least limiting the recourse to manual intervention. Some of these apparatuses rely on vacuum systems to pick up, lift and transport the leathers starting from a pickup station where the leathers are superimposed to form a stack, up to a release zone where the leathers are released towards the downstream line.

However, the known apparatuses are not satisfactory with respect to the requirements of planarity which, as mentioned, it is desirable to be conferred to the leathers released and loaded on the conveyor surface of the line, which, on the contrary, by effect of the deformation induced by the picking and release sequence, are frequently affected by irregularities that must be corrected with manual intervention. In general, the handling reliability and precision are other aspects on which such apparatuses can be greatly improved.

SUMMARY OF THE INVENTION

Taking these issues into account, the applicants managed to realize an apparatus capable of making the handling and the loading of even large and very irregularly profiled leathers or hides particularly reliable, ensuring the planarity of the leather when loaded onto the conveyor surface of the line, all while minimizing or even eliminating the recourse to workforce.

Such leather loading apparatus for lines of treatment or working thereof, according to the present invention, has the essential characteristics mentioned in the first of the appended claims. Other ancillary features are the subject-matter of the secondary claims.

SHORT DESCRIPTION OF THE DRAWINGS

The characteristics and the advantages of the hide feeding apparatus in lines of treatment or working thereof according to the present invention will become apparent from the following description of one of its embodiments, made by way of non-limiting example, with reference to the attached drawings in which.

Figure 5:
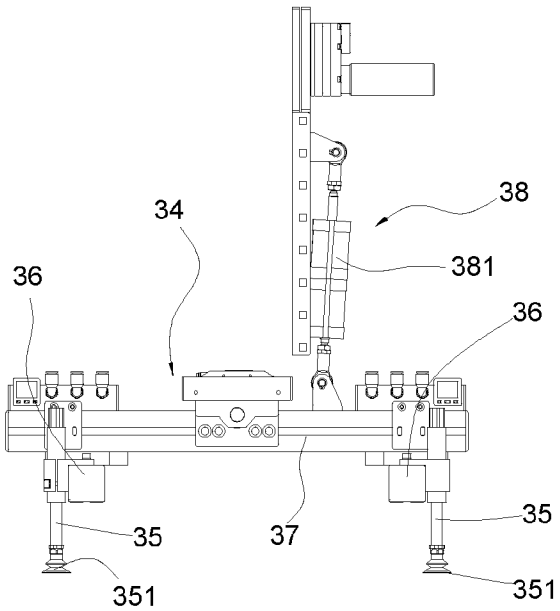
Figure 4:
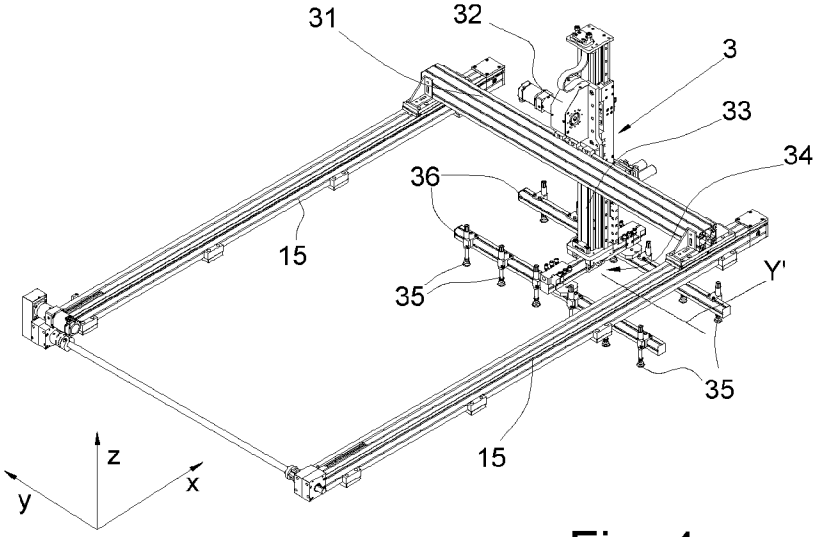
FIG. 4 is an axonometric view of a leather handler device of the apparatus of the previous figures, represented in isolation.
Figure 6A:
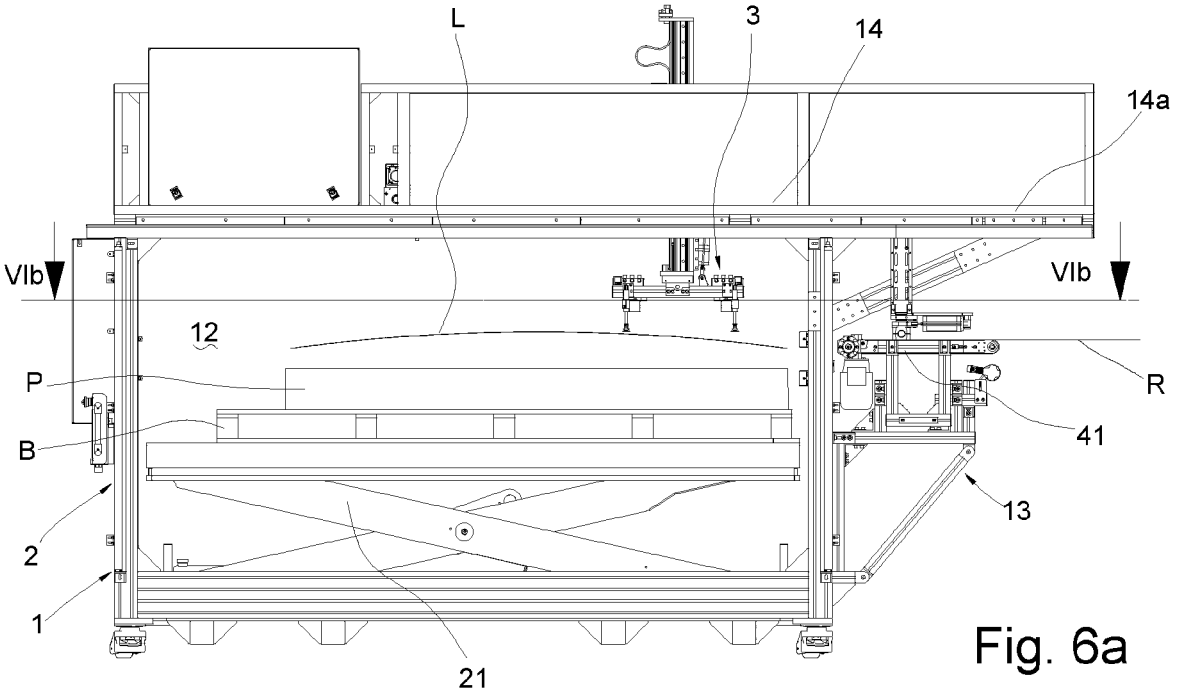
Figure 6B:
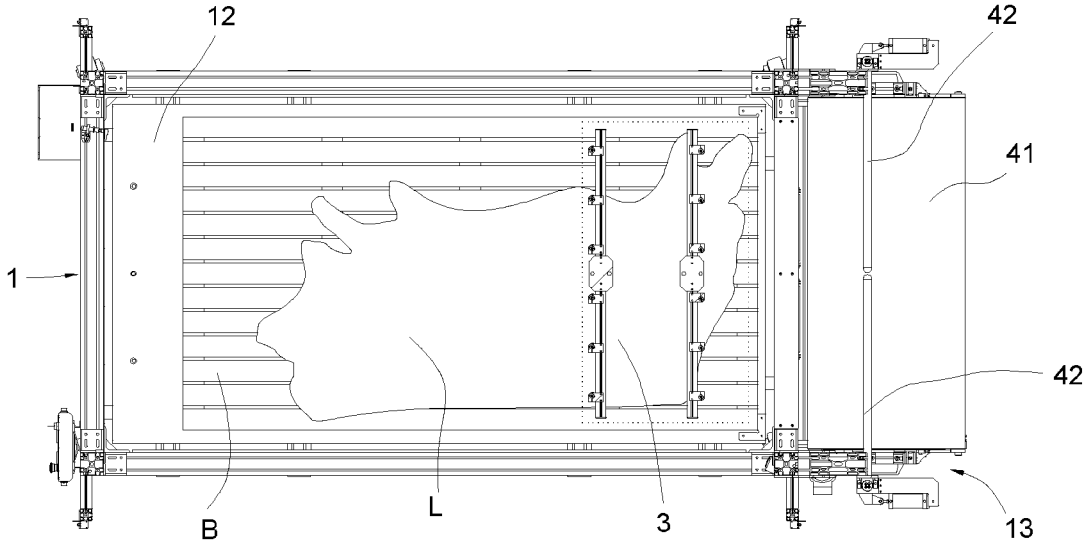
Figure 7:
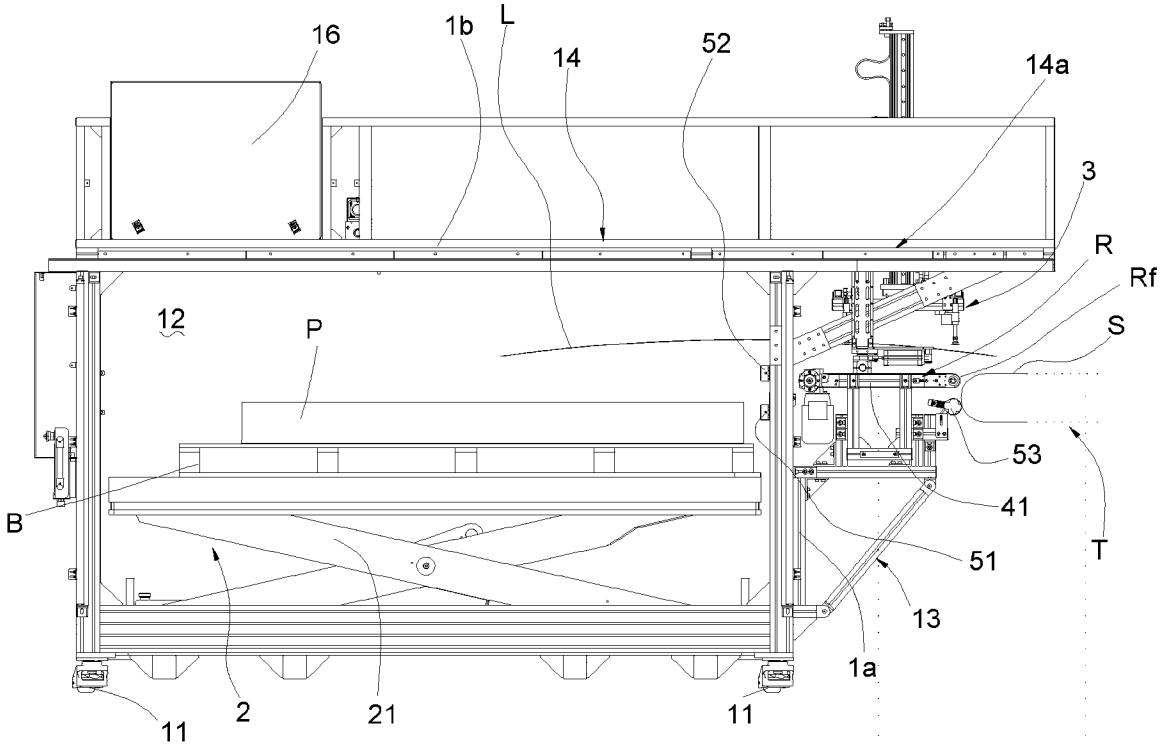
Figure 8A:
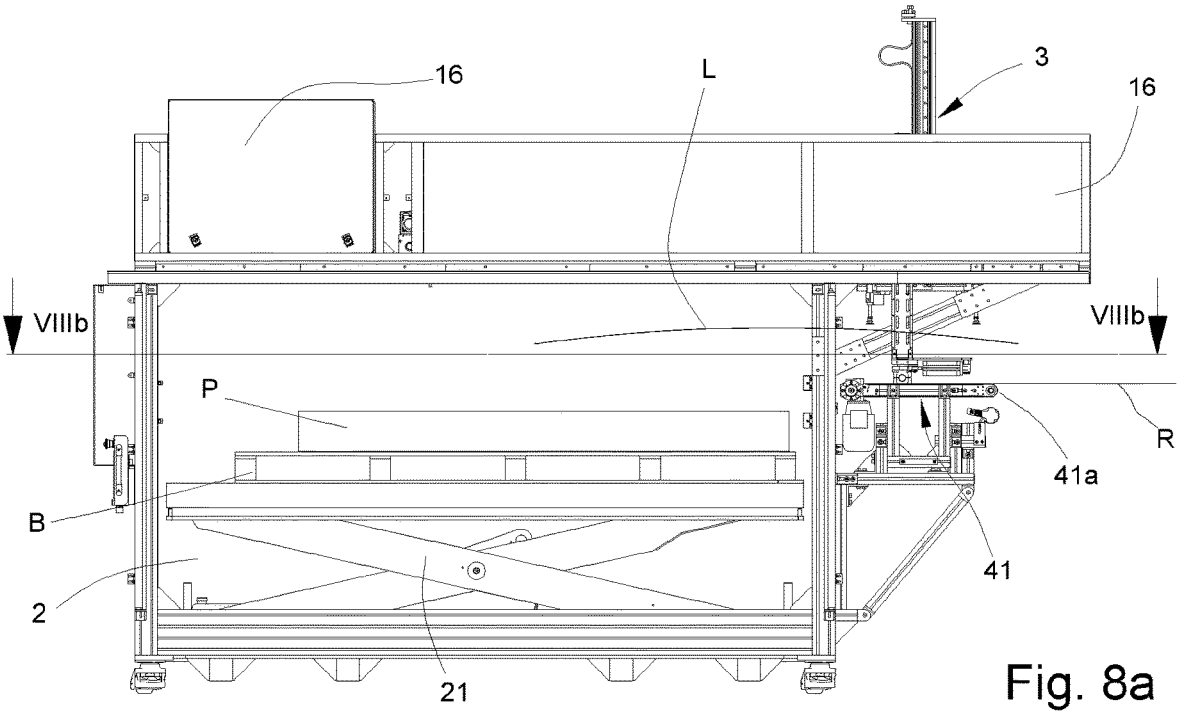
Figure 8B:
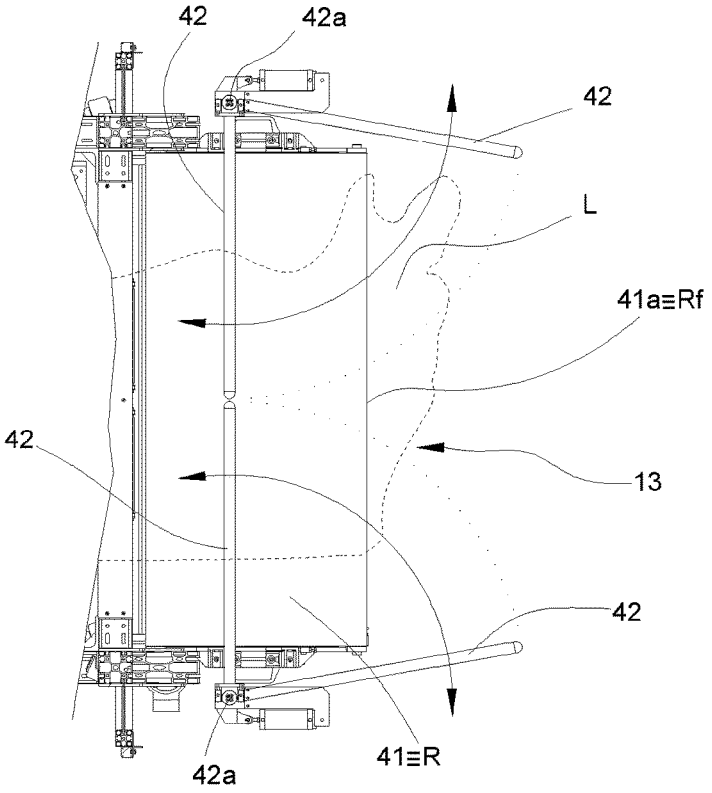

FIG. 5 is a side view of a suction pickup mount of the device of FIG. 4, represented in isolation; and FIGS. 6*a* to 8*b* are representative of the respective successive operating steps of the apparatus of the previous figures, and in particular: FIG. 6*a* and FIG. 6*b* are side views and according to the plane VIb of FIG. 6*a* respectively, of the apparatus in a step of picking and lifting a single leather from the pickup station; FIG. 7 is a side view of the apparatus in a step of advancing the leather; FIG. 8*a* and FIG. 8*b* are side views and according to the plane VIIIb of FIG. 8*a* (partial and enlarged view), respectively, of the apparatus in a step of spreading and releasing the leather.

DETAILED DESCRIPTION OF THE INVENTION

With reference to said figures, the apparatus according to the invention comprises a lattice frame 1 that rises from a base with feet 11 resting on the ground. Internally, the frame, which is tendentially parallelepiped, delimits a pickup station 12, configured as a compartment adapted to accommodate a stack of leathers to be loaded and for this purpose hosting a platform 2 that can be elevated according to an elevation direction Z typically but not necessarily vertical.

An advancement direction X of the leathers or hides is defined by and on the frame 1 and with the elevation direction Z and with a third crosswise direction Y forms a Cartesian triad. The advancement direction X develops between the pickup station 12 and a frontal side 1*a* of the frame on which from the frame itself a release region 13 protrudes with a release plane R parallel to the directions XY and at a certain level according to the elevation direction, a level that preferably leads this release plane to be parallel, and even more preferably coplanar, to the conveyor surface ST of a treatment or working line T—shown schematically here only in FIG. 7—on which the leathers must be loaded, downstream of the apparatus. The release region 13, and in particular a frontal edge Rf of the release plane R, are in fact intended for a contiguous positioning with the aforesaid transport line and surface.

On an upper side 1*b* the frame 1 comprises a structure 14 with a portion 14*a* projecting in turn beyond the frontal side 1*a* so as to extend as far as above the release region 13. This structure 14 movably supports along the advancement direction X, through a pair of guides 15, a handler device 3 for lifting the single leathers, according to the elevation direction Z, from the pickup station 12 and their advancement along the advancement direction X towards the release region 13. The upper area of the structure is surrounded, in the depicted exemplifying embodiment, by protective shields 16 in compliance with accident prevention regulations well known to the person skilled in the art.

Figure 2:
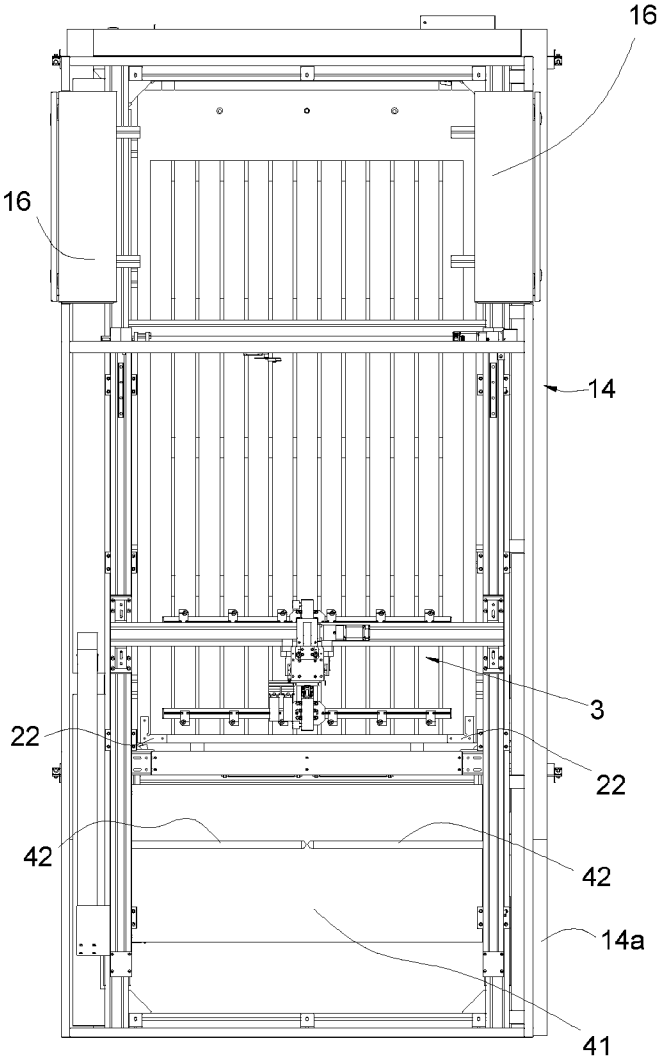

The platform 2 is liftable by means of a parallelogram actuator mechanism 21, and configured to support the leathers stacked in a stack P, schematically indicated in FIGS. 6*a* to 8*b*, usually with interposition of a transportation pallet B, represented in the various figures. The platform preferably has end-of-stroke stops 22 (FIG. 2) to precisely reference the position of the pallet, and more generally of the stack, at the frontal side 1*a* and thus in contiguity with the release region 13.

According to an advantageous aspect, two optical sensors 51, 52, placed at different heights on the frontal side 1*a* (FIG. 7) are adapted to detect a minimum level and a maximum level of the top of the stack of leathers, and therefore of the position of the highest leather that will gradually be subject to handling. The highest sensor 52 can be substantially at the same height as the release plane R. A control system of the apparatus, which will be further discussed hereafter, is apt to control the elevation of the platform, based on the signals detected by the sensors 51, 52, so as to keep the aforesaid top of the stack always within the height range between the predetermined minimum level and maximum level as the leathers are picked up from the handler device 3. In this way, the leather being picked has, as its starting position of its lifting motion, a height within this range, that corresponds to a position already close to the release plane, with consequent reduced extent of the lifting and further reduced deformation of the leather at this step of the loading process.

The handler device 3, shown in particular in FIGS. 4 and 5, comprises a crosspiece 31 whose ends slide on the already mentioned guides 15 (sliding in the advancement direction X). A guide and operating box 32 for an upright 33 that extends in the elevation direction Z and is slidable along it to ensure the lifting action of the leather is mounted on the crosspiece 31, which thus extends in the crosswise direction Y, possibly with the possibility of position adjustment in the aforesaid crosswise direction.

The upright 33 in turn bears a scaffold 34 for supporting fingers 35 for handling by suction or vacuum, as the case may be. The scaffold 34 comprises in the preferred embodiment illustrated herein at least two groups of fingers 35 organised in respective rows supported by parallel transverse beams 36, each row/beam being arranged according to the crosswise direction and spaced with respect to the other(s) in the advancement direction. The mounting of each finger 35 along its own beam 36 is position-adjustable so as to individually change the positions along the crosswise direction. For example, there may be provided two rows of five or six fingers each but this scheme is obviously not to be understood as limiting.

In an advantageous form of the invention the control means are programmed so that the two rows of fingers supported by the transverse beams 36 release the leather at different times, with the row arranged in front, in the advancement direction, which releases before the rear row. This reduces the risk of jamming and therefore generates a more effective release of the leather.

The transverse beams 36 are joined and supported by a longitudinal beam 37, so as to ensure a position adjustment, in the sense of varying/adjusting the distance between the two rows of fingers 35 according to the advancement direction X. The longitudinal beam 37 is then suspended from the upright 33 through an articulation mechanism 38 controlled by an actuator 381, configured so as to allow a rotation of the longitudinal beam 37, and therefore of the entire set of the fingers, around an axis Y' parallel to the crosswise direction Y.

Speaking more specifically about each finger 35 this can be realised in the form of a cylindrical tubular sleeve that conveys a vacuum to a lower end on which a bellows suction cup 351 is arranged, defining the relative suction port. A similar suction effect can also be guaranteed with a dedicated system or device and not necessarily a suction cup, anyway capable as a whole of generating a vacuum pressure useful for the purpose. The suction devices, as well as a mounting to the relative transverse beam through mounting means that ensure a possibility of elastically opposed rearward displacement (for example with a spring-counteracted slider) in the elevation direction Z, introduce a further advantageous feature of adaptability and effectiveness of the picking, ensuring the compensation of any defects of orthogonality or alignment.

In a preferred embodiment of the invention, the fingers 35, and in particular the relative suction ports, touch all the leather at the same time and all apply the same vacuum pressure and therefore the same lifting force. This results in a more effective picking and movement of the leather.

Therefore, turning the focus to the release region 13, this also envisages, in association or integration with the release plane R, means 4 for spreading the leather, to ensure a release and a loading thereof on the line in a completely planar arrangement, which can assume various embodiments, and through one or more devices associated with each other. Two of these are adopted precisely in mutual association in the illustrated example, an outlet belt 41 which, by embodying the release plane R, also makes it movable and a system making use of movable means for catching the release of the leathers arranged at a higher level than the release plane. Beyond this association, the apparatus can still operate with a satisfactory result even if only one of the above-mentioned systems, or variants thereof, are used.

The outlet belt 41 has the shape of a motorized conveyor belt that with its upper segment defines the release plane R, and is made of a material capable of ensuring a high coefficient of static friction with the leather deposited therein, with the spreading effects of the material that will be better understood shortly. By way of example only, cross-linked polyurethane coated with acrylonitrile butadiene rubber (NBR) may be used.

Figure 1:
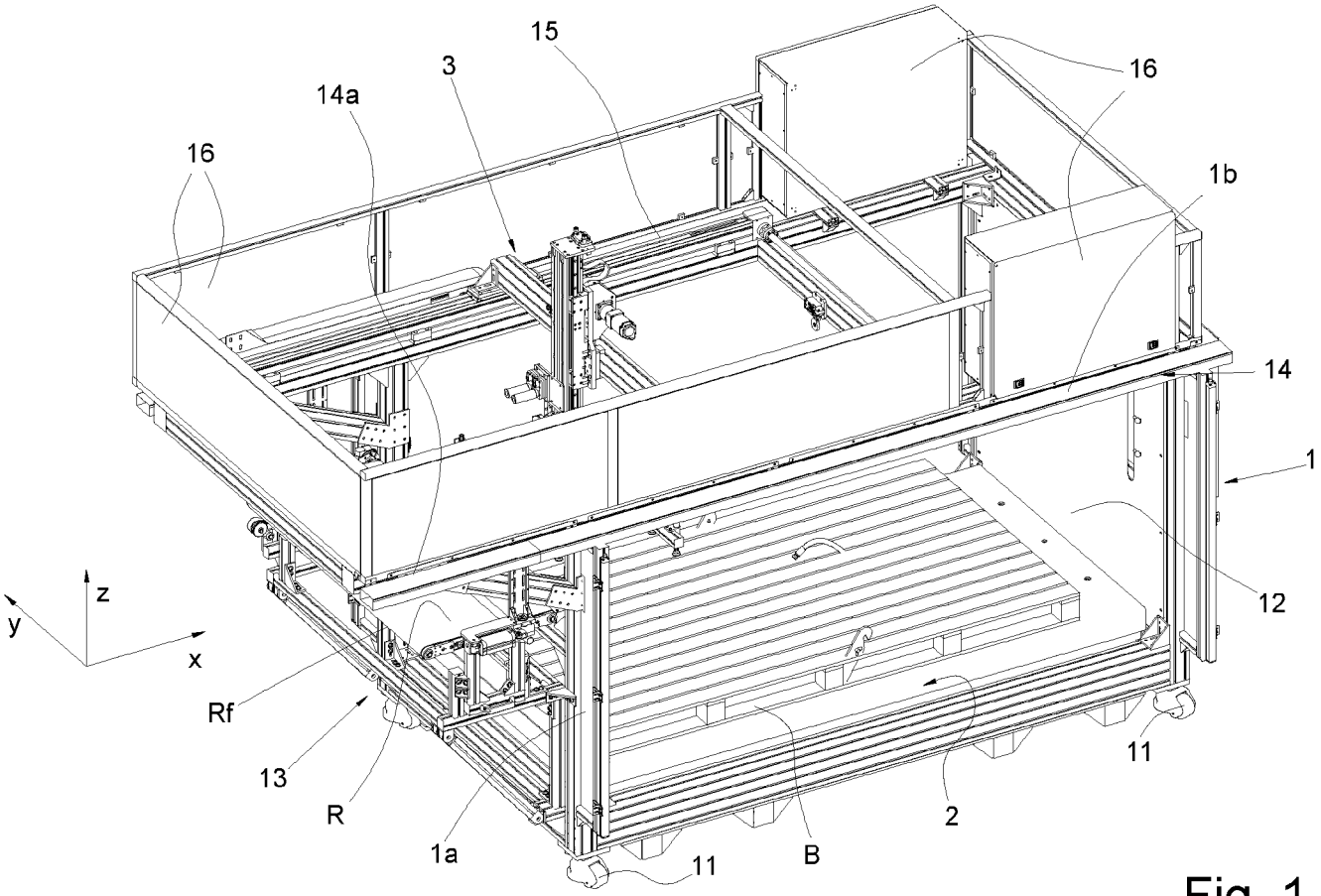
FIG. 1 is an axonometric view of an apparatus according to the present invention, unloaded and with a liftable platform of a pickup station in a lowered configuration.
Figure 3:
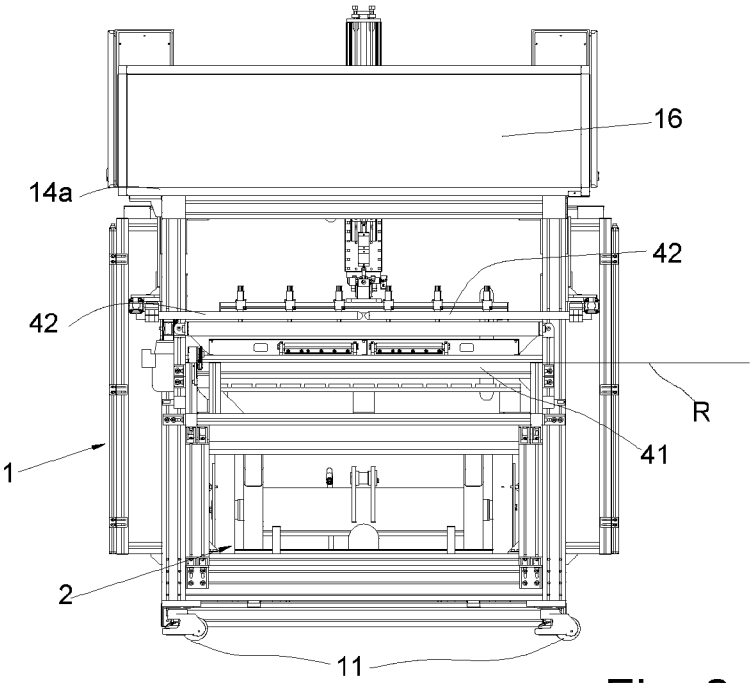
FIGS. 2 and 3 are top and front views (release and exit side of the leathers towards the line) of the apparatus of FIG. 1.

As far as the movable members of the catching system are concerned, they can comprise two rods 42 movable on the plane XY, being for example hinged at first ends 42*a* arranged on respective sides of the release plane around vertical hinge axes, and also having a longitudinal extension equal to about half, or slightly less than half, of the extension of the aforesaid release plane R in the crosswise direction. The rotation of the rods, commanded by respective actuators, therefore takes place between an open condition, in which they are arranged along the sides of the plane R completely freeing the space above, and a catching condition (which is the one of FIGS. 1, 2 and 3) in which they appear to stand over the plane with an arrangement aligned with the crosswise direction Y. Between the two positions, clearly the rods each sweep an angle of 90° to affect widthwise the entire plane R and lengthwise (advancement direction X) an area astride between the plane R and the conveyor surface downstream of the frontal edge Rf of the plane (here represented by a frontal edge 41*a* of the belt 41).

A programmable control system (typically of a digital microprocessor nature), not shown, has the task of managing the apparatus automatically on the basis of preset instructions, in order to implement the partly anticipated operating behaviour and to which we will return shortly, in particular also interfacing with the line T to manage the advancement speed of the outlet belt 41 also based on the detected speed of the conveyor surface ST. For example, a wheel encoder 53 (FIG. 7) that detects the speed of the line conveyor may be used for this purpose. The hardware and software configuration of the system will have characteristics in themselves known or obviously devisable in the context of industrial automation, the implementation of which is not as such pertinent to the invention and does not require a detailed description for the person skilled in the art. Having said that, the control of the apparatus can likewise be exerted with a semi-automatic modes, i.e. requiring in one or more steps real-time instructions from a designated person. Likewise not illustrated or described, for the same reasons, are the characteristics of the electrical, electronic and pneumatic circuitry, the specifications of the sensors and motorisations and actuation, and in general the specific construction methods of the mechanical connections, on which, moreover, what can be deduced from the figures is perfectly exhaustive for the person skilled in the art.

Operationally, with particular reference to FIGS. 6*a* to 8*b*, in the apparatus according to the invention a stack P of overlapped leathers is thus loaded in the pickup station 12, with the platform initially lowered and with the control system that then manages the progressive lifting thereof, as seen thanks to the sensors 51, 52, so that the first upper leather of the stack, that is, obviously the one that must be picked up gradually, is always at a level close to or even aligned with that of the release plane R. In this way, since the pickup position is so elevated, the necessary lifting is very modest and consequently the extent of the deformation of the leather with respect to the planarity condition is limited.

In FIGS. 6*a* and 6*b*, this leather, indicated with L, has been picked up by the handler device and lifted enough to be brought above the release plane 13. Advantageously the picking occurs on a leather head or introduction flap also in this case to minimize deformation. As already described, the preferred embodiment characteristics of the device allow it to be configured effectively based on the characteristics of shape of the leather and to effectively compensate for any reference defects; in general, an at least double row of suction fingers makes the picking safe and always reliable. Advantageously, vacuum switches can be installed to check that the correct vacuum degree has been reached, in order to detect any anomalies. A further sensor can detect the exact height of the pickup level and consequently automatically adjust the height at which the handler must stop for the picking.

In a further embodiment of the invention, the control means of the apparatus may integrate a sensor capable of discriminating the specific side of the leather exposed to the pickup system (identifying whether it is a grain side or a meat side) so as to operate a leather tilting system, a system that is per se known, prior to its release on the line.

This is particularly useful in the event that the leathers have been stacked on the platform in no particular order by the operators or by previous machinery and working stations, thus being able to position the leather on the line of the next treatment, on the right working side, and without any need for intervention by operators.

Similarly, in a still further advantageous embodiment of the invention, the platform on which, through the platforms, the leathers are stacked, can be rotatable, being provided with a rotation system implemented with known techniques, so as to also achieve a movement and working of the leather in a crosswise direction.

The handling device then advances (FIG. 7) until the leather introduction flap L is brought towards and beyond the outlet belt 41. The fact that the picking has taken place on the head or introduction flap leads the central part and the opposite part of the leather, by effect of the advancement, to naturally spread. By dropping the leather astride between the belt 41 and the conveyor surface of the line ST, this enters the range of action of the rods 42, which initially, in the closed position, catch the leather and then, by opening, cause it to spread out in all directions by effect of the aforesaid opening by rotation, eliminating any undue folds on the frontal part of the leather (FIGS. 8*a* and 8*b*).

In general, the contribution of the rods 42 or similar movable catching systems, such as, for example, air blades adapted to support the material by means of a pneumatic jet of suitable pressure and appropriate direction, and the action of the outlet belt 41, on which the leather is finally deposited, can advantageously be combined, as in the illustrated embodiment, but can also be advantageous when used individually (i.e. one in the absence of the other). As far as the belt is concerned, it can in itself favour the spreading, because the friction greater than that of the conveyor surface tends to retain the opposite (or tail) part of the leather with a stretching effect; likewise, the control system can slow down or stop, with continuous or intermittent modes, the motion of the belt as a function of that of the conveyor surface ST of the line (detected as said by the encoder 53), always in order to exert a retention and spreading action.

Obviously, the cycle continues similarly for the subsequent leathers of the line until exhausted.

The advantages of the apparatus according to the invention emerge clearly from the above described. A system is provided that ensures a load of leathers for the subsequent processings with an arrangement substantially free of folds or creases, wrinkles or any significant planarity defects, with a degree of performance unprecedented in the reference sector and little or no recourse to workforce. All this even if the treated leathers are very irregular, heavy or with different degrees of porosity.

The described apparatus can be part of a flexible laminar element treatment or working plant; in general, examples of lines that can include the apparatus can be considered all those that use conveyor belts of various types or machinery that use introduction belts.

The present invention has been described thus far with reference to the preferred embodiments thereof. It is to be understood that there may be other embodiments that relate to the same inventive nucleus, all falling within the scope of protection of the claims provided below.

The invention claimed is:

1. An apparatus for picking, transporting and releasing flexible laminar elements from a pickup station of the apparatus to a conveyor surface of an element treatment or processing line arranged downstream of the apparatus, wherein the apparatus comprises:

said flexible laminar element pickup station, adapted to receive the elements in a superimposed arrangement forming a pile;

an element release region, adapted to face said line conveyor surface and comprising a release plane for the flexible laminar elements;

a lifting and advancement unit configured to lift and advance individual flexible laminar elements from said pickup station along an elevation direction orthogonal to said release plane and to sequentially advance the flexible laminar elements to said release region along an advancement direction parallel to said release plane;

an unfolding unit arranged in said release region and configured to unfold the individual flexible laminar elements and to load the flexible laminar elements on said conveyor surface in a substantially planar configuration; and a control system configured to control said lifting and advancement unit and said unfolding unit.

2. The apparatus according to claim 1, wherein said unfolding unit comprises an outlet conveyor belt defining said release plane and made of a material with a high static friction coefficient with respect to said flexible laminar elements, said lifting and advancement unit being configured to release single flexible laminar elements with a frontal flap on said conveyor surface and an opposite flap on said outlet conveyor belt, said control system being configured to control an advancement speed of said conveyor belt in a coordinated manner with an advancement speed of said conveyor surface.

3. The apparatus according to claim 1, wherein said unfolding unit comprises a movable catching device configured to catch the flexible laminar elements released by said lifting and advancement unit, said movable catching device being operatively arranged at a higher level than said release plane and being provided with at least one component of movement parallel to said release plane.

4. The apparatus according to claim 3, wherein said movable catching device is provided with at least one component of movement according to a crosswise direction orthogonal to said advancement direction.

5. The apparatus according to claim 3, wherein said movable catching device comprises one or more movable rods adapted to move over a plane parallel to said release plane.

6. The apparatus according to claim 5, wherein said one or more movable rods are further adapted to pivot around a hinge axis orthogonal to said release plane.

7. The apparatus according to claim 3, wherein said movable catching device comprises one or more air blades.

8. The apparatus according to claim 1, wherein said lifting and advancement unit comprises a handler device reciprocating along said advancement direction between said pickup station and said release region, and along said elevation direction, said handler device comprising at least two rows of suction ports spaced apart in said advancement direction and configured to engage with a frontal flap of said flexible laminar elements arranged in said pickup station.

9. The apparatus according to claim 8, wherein said suction ports are defined by respective handling fingers mounted in an adjustable arrangement, one by one or in groups, along said advancement direction and along a crosswise direction orthogonal to said advancement direction and to said elevation direction.

10. The apparatus according to claim 9, wherein said handling fingers are mounted in rows on respective supporting transverse beams, through mounting members adapted to permit an elastically opposed rearward displacement of each finger in the elevation direction.

11. The apparatus according to claim 8, wherein said control system is configured to let the flexible laminar elements be released by said rows at different times.

12. The apparatus according to claim 8, wherein said lifting and advancement unit and said control system is configured to make said suction ports touch the flexible laminar element all at the same time and with the same suction pressure.

13. The apparatus according to claim 1, wherein said pickup station comprises a support platform for said pile of superimposed flexible laminar elements, the platform being adapted to be lifted along said elevation direction, said control system comprising at least one sensor configured to detect a height of the pile of superimposed flexible laminar elements and to control at least the elevation height of said platform in response to a height of the pile detected by said at least one sensor.

14. The apparatus according to claim 13, wherein said platform is rotatable thereby allowing movement and processing of the flexible laminar element in a transverse direction.

15. The apparatus according to claim 1, wherein said control system comprises a side detection sensor adapted to recognize the side of the flexible laminar element exposed to said lifting and advancement unit, and configured to drive a system for overturning the flexible laminar element in response to a detection of said side of the flexible laminar element.

16. The apparatus according to claim 1, wherein said release plane is parallel to or coplanar with said conveyor surface.

17. The apparatus according to claim 1, wherein said elevation direction is a vertical direction.

18. A plant for treating or processing flexible laminar elements comprising an apparatus according to claim 1.

19. The apparatus according to claim 1, wherein said control system is configured to release flexible laminar elements at a frontal position relative to the advancement direction before flexible laminar elements at a rear position.

* * * * *